US009481960B2

(12) United States Patent
Sofy et al.

(10) Patent No.: US 9,481,960 B2
(45) Date of Patent: Nov. 1, 2016

(54) BODY ENGAGING CONCAVE CONTAINER

(71) Applicant: HMS Mfg. Co., Troy, MI (US)

(72) Inventors: Janet M. Sofy, Troy, MI (US); Randal J. Petkoff, Shelby Township, MI (US)

(73) Assignee: HMS MFG. CO., Troy, MI (US)

( * ) Notice: Subject to any disclaimer, the term of this patent is extended or adjusted under 35 U.S.C. 154(b) by 0 days.

(21) Appl. No.: 14/808,097

(22) Filed: Jul. 24, 2015

(65) Prior Publication Data

US 2016/0040351 A1 Feb. 11, 2016

Related U.S. Application Data

(60) Provisional application No. 62/034,980, filed on Aug. 8, 2014.

(51) Int. Cl.

| | |
|---|---|
| ***B65D 1/38*** | (2006.01) |
| ***D06F 95/00*** | (2006.01) |
| ***B65D 25/30*** | (2006.01) |

(52) U.S. Cl.

CPC ..... *D06F 95/002* (2013.01); *B65D 1/38* (2013.01); *B65D 25/30* (2013.01)

(58) Field of Classification Search

CPC ..... D06F 95/002; A45C 5/045; A45C 3/04; B65D 1/38

USPC ..... 220/914, 669

See application file for complete search history.

(56) References Cited

U.S. PATENT DOCUMENTS

| | | | | |
|---|---|---|---|---|
| 6,039,205 | A | 3/2000 | Flink | |
| D425,275 | S * | 5/2000 | Delouvre | D32/37 |
| D438,010 | S * | 2/2001 | Drury | D3/307 |
| 7,677,408 | B2 | 3/2010 | Loucks et al. | |
| 2005/0189360 | A1* | 9/2005 | Loucks | D06F 5/002 220/676 |
| 2008/0073865 | A1* | 3/2008 | Alves | A45C 3/04 280/33.998 |

FOREIGN PATENT DOCUMENTS

AU WO 2007106940 A1 * 9/2007 ..... A45C 3/04

* cited by examiner

*Primary Examiner* — J. Gregory Pickett
*Assistant Examiner* — Allan Stevens
(74) *Attorney, Agent, or Firm* — Dickinson Wright PLLC

(57) ABSTRACT

The container (20) comprises a base (22), a concave wall (24), a convex wall (26), and a pair of side walls (28) with all walls (24, 26, 28) extending upwardly from the base (22) to a rim (30) which presents an engaging area (50) having an apex (52) and midpoint (54). The apex (52) of the engaging area (50) is disposed a greater distance from the base (22) than the distance of the top (38) of the rim (30) from the base (22) along the side walls (28) and the convex wall (26), whereby the engaging area (50) presents a concave surface area for supporting the container (20) on the hip of a human body. The engaging area (50) further includes a second dimension ($h_2$) which decreases in height along the rim (30) from the apex (52) and the midpoint (54) of the engaging area (50) toward each side wall (28). The engaging area (50) further includes a support plane ($\rho_3$) which slants relative to vertical at an acute angle ($\theta$) allowing the engaging area (50) to rest comfortably on the human body.

10 Claims, 5 Drawing Sheets

BODY ENGAGING CONCAVE CONTAINER

CROSS REFERENCE TO RELATED APPLICATION

This application claims the benefit of provisional application Ser. No. 62/034,980 filed Aug. 8, 2014.

BACKGROUND OF THE INVENTION

1. Field of the Invention

The present invention relates to a container having a concave side for engaging the hip of a human body while being grasped on an opposite convex side by an arm extending from that human body. For example, a hip-hugging laundry basket.

2. Description of the Prior Art

A container or laundry basket is designed to carry dirty laundry or other articles. Such a container is disclosed in U.S. Pat. No. 6,039,205, issued to Mar. 21, 2000, in the name of Flink. This container includes a base, a concave wall, a convex wall, and a pair of side walls. All of the walls extend upwardly from the base to a rim surrounding a chamber therein to define a cross section of bean shape.

SUMMARY OF THE INVENTION

The invention provides such a container characterized by a rim presenting an engaging area in the rim which extends along the concave wall and is disposed a greater distance from the base than the distance of the rim from the base along the side walls and the convex wall, whereby the engaging area presents a concave surface area for supporting the container on the hip of a human body.

ADVANTAGES OF THE INVENTION

The container in its broadest aspect provides a concave surface area which provides comfort while carrying the container on the hip of a human body. Furthermore, the engaging area of the container along the concave wall is the highest point of the rim and allows the arm of the human body to comfortably carry the container on the hip of the human body by the arm reaching and grasping the rim at the lower opposite convex wall, which allows the arm to comfortably rest closer to the human body while carrying the container.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
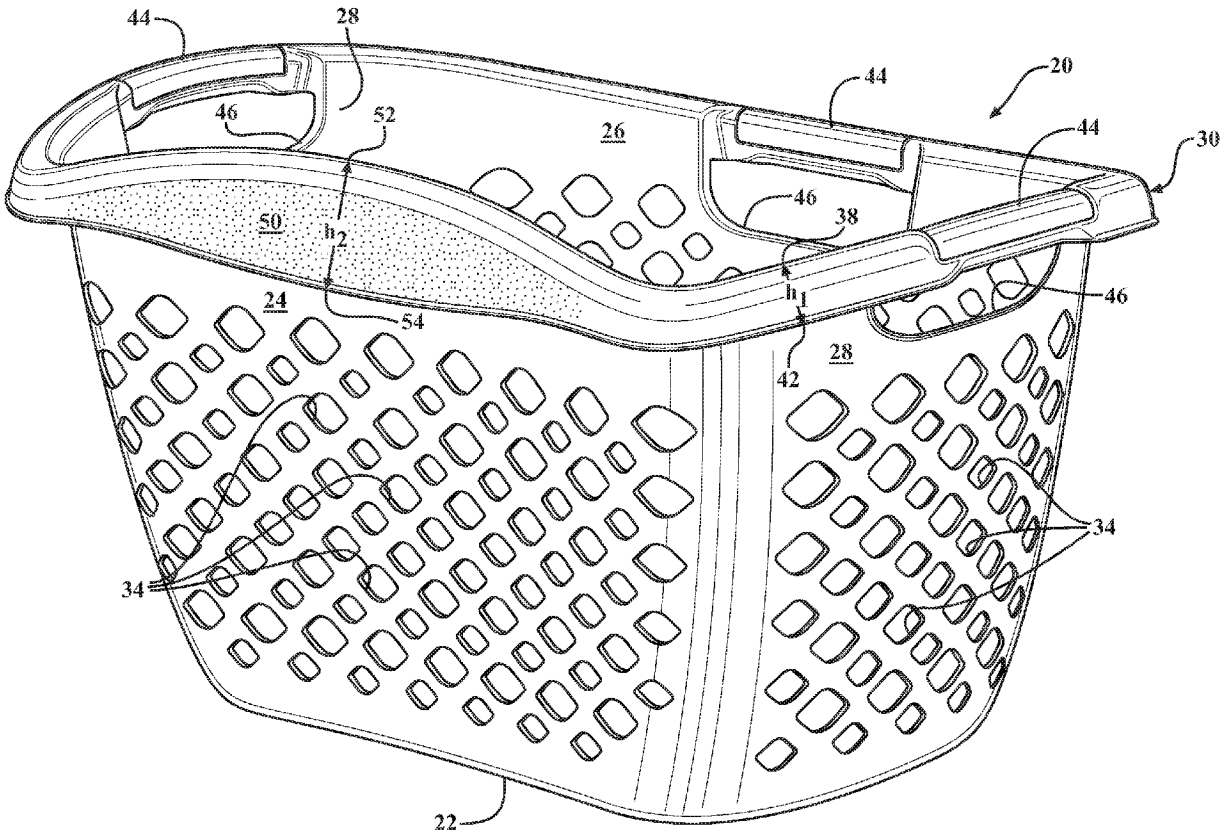
FIG. 1 is a perspective view of the enabling embodiment.
Figure 2:
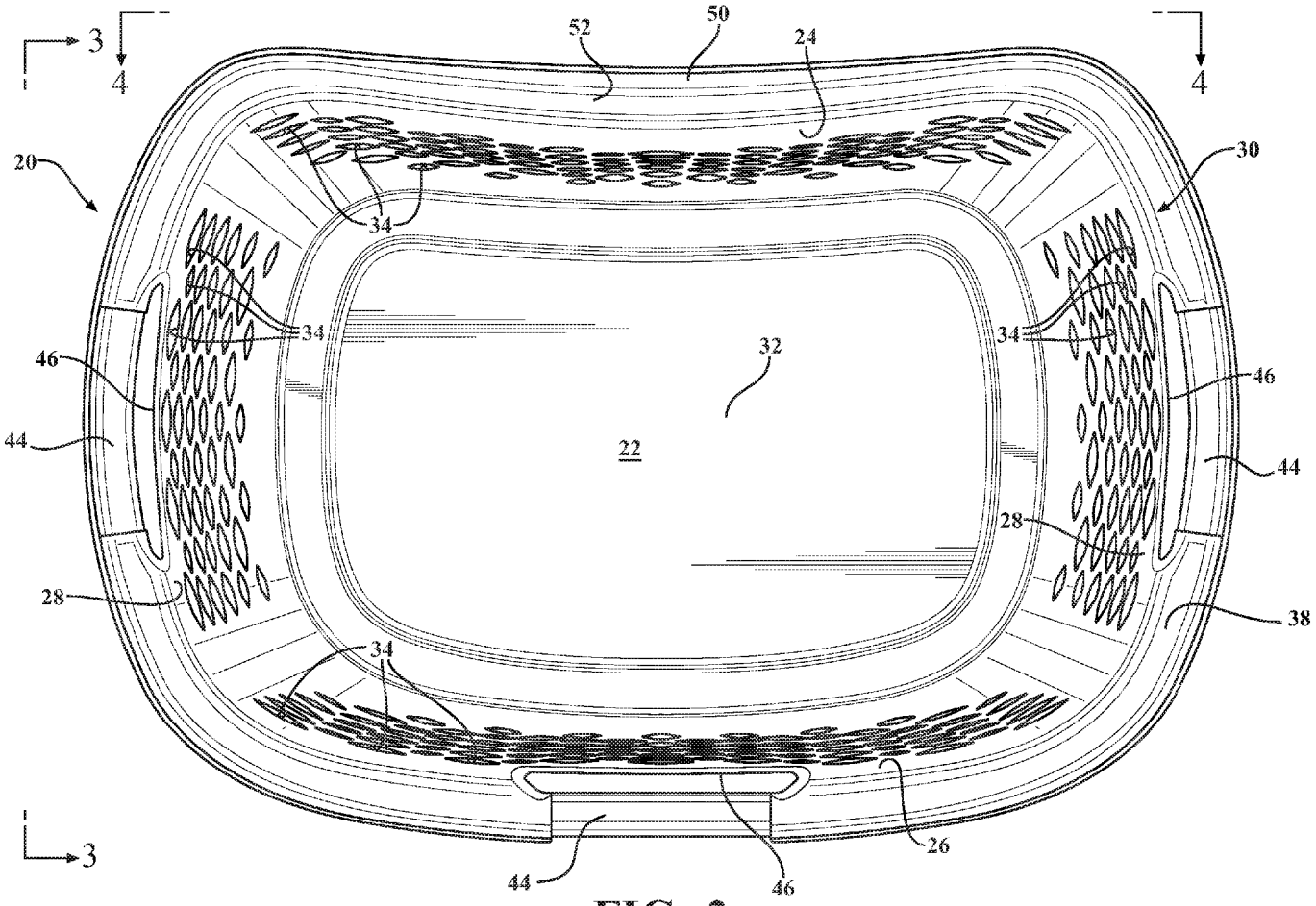
FIG. 2 is a top view of the enabling embodiment.

Referring to the Figures, wherein like numerals indicate corresponding parts throughout the several views, a container 20 is generally shown having a concave side for engaging the hip of a human body while being grasped on an opposite convex side by an arm extending from that human body. In the enabling embodiment, the container 20 takes the form of a hip-hugging laundry basket. However, it should be appreciated that the container 20 could alternatively have other forms, such as, but not limited to, a bin or a tote.

The container 20 comprises a base 22, a concave wall 24, a convex wall 26, and a pair of side walls 28 with all of the walls 24, 26, 28 extending upwardly from the base 22 to a rim 30 which surrounds a chamber 32 therein and defines a cross section of bean shape. More specifically, the concave wall 24 is arcuate between the side walls 28 and is bowed into the chamber 32 toward the convex wall 26, whereas the convex wall 26 is arcuate between the side walls 28 and bowed out of the chamber 32 away from and generally parallel to the concave wall 24.

All of the walls 24, 26, 28 of the container 20 may present an array of holes 34 with each hole 34 being lemon-shaped or walnut-shaped and disposed in a plurality of vertical rows. In other words, each row extends transversely to and between the rim 30 and the base 22 with each row being equally spaced apart along the walls 24, 26, 28. Each alternate row either increases or decreases in size from the rim 30 to the base 22. It is to be understood that the holes 34 may be of any shape and the container 20 may not include any holes 34.

Figure 6:
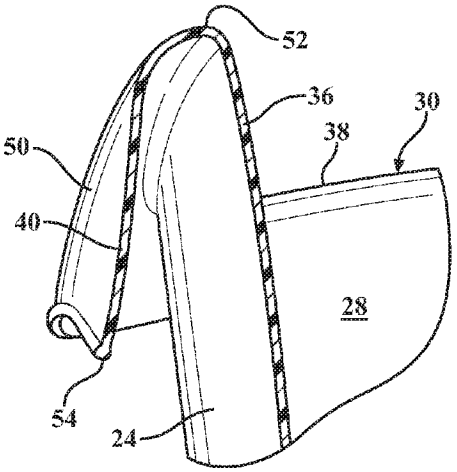
FIG. 6 is a cross sectional view of the engaging area taken along the line 6-6 of FIG. 4.

As generally indicated, the rim 30 of the container 20 extends about the walls 24, 26, 28 and defines a generally U-shaped cross section. The rim 30 is defined by an inner leg 36 extending from the walls 24, 26, 28 to a top 38, and as best shown in FIG. 6, the rim 30 further extends from the top 38 in an outer leg 40 to present an edge 42 which extends about and is spaced outwardly from the walls 24, 26, 28.

The top 38 of the rim 30 includes a plurality of handles 44 which are attached flush with the top 38 of the rim 30 along the convex wall 26 and each of the side walls 28 for decorative purposes. The convex wall 26 and the side walls 28 each define a grip opening 46 with each grip opening 46 being semicircular and disposed adjacent the rim 30 and extending toward the base 22 to allow grasping of the rim 30 at each of the handles 44 for carrying the container 20.

The outer leg 40 of the rim 30 extends a first dimension $h_1$ between the top 38 of the rim 30 and the edge 42 of the rim 30 along the side walls 28 and the convex wall 26. To provide less tension on the arm of the human body, the top 38 of the rim 30 along the convex wall 26 is closer to the base 22 than the top 38 of the rim 30 along the side walls 28. Said another way, the top 38 of the rim 30 extends along the side walls 28 a greater distance from the base 22 than the top 38 of the rim 30 extends from the base 22 along the convex wall 26.

Figure 3:
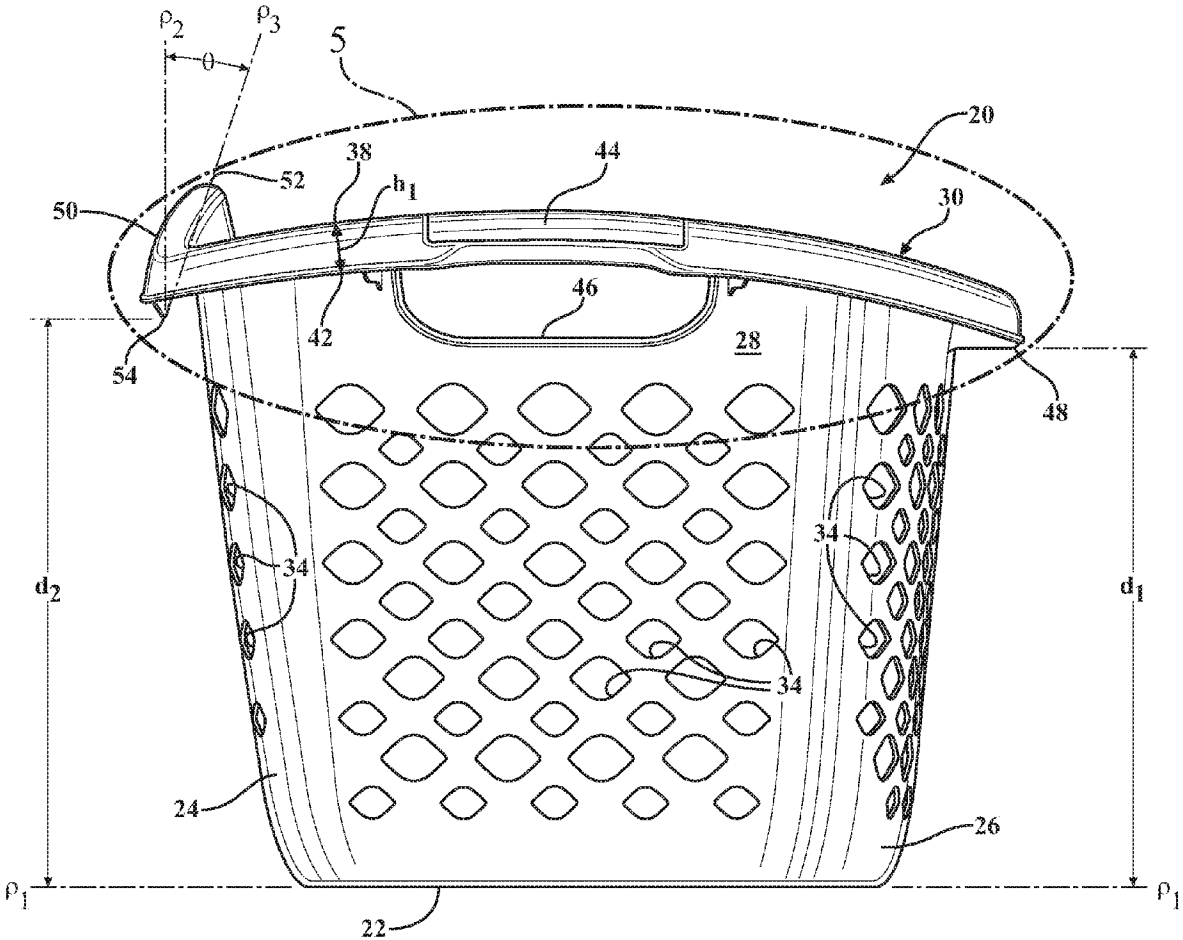
FIG. 3 is a side view of the side wall along the line 3-3 of FIG. 2.

As best shown in FIG. 3, the base 22 of container 20 defines a lower plane $\rho_1$ wherefrom all of the walls 24, 26, 28 diverge upwardly to the inner leg 36 of the rim 30. The convex wall 26 defines a reference point 48 along the edge 42 of the rim 30 which is equidistant from each of the side walls 28 and is spaced a first distance $d_1$ from the lower plane $\rho_1$.

The outer leg 40 of the rim 30 further extends a second dimension $h_2$ between the top 38 of the rim 30 and the edge 42 of the rim 30 along the concave wall 24 to present an engaging area 50 in the rim 30. The second dimension $h_2$ of the engaging area 50 extends along the concave wall 24 greater than the first dimension $h_1$ of the rim 30 extends along the convex wall 26 and along the side walls 28. Accordingly, as best shown in FIG. 3, the engaging area 50 in the rim 30 is larger along the concave wall 24 than presented by the remainder of the rim 30 along the convex wall 26 and along the side walls 28. The engaging area 50 of the rim 30 has an elongated oval shape which is flexible inwardly toward the inner leg 36 of the rim 30 and toward the concave wall 24 in response to an applied force. Additionally, the engaging area 50 of the rim 30 may include a gripping texture to inhibit slippage of the engaging area 50 from the applied force while being held against the human body, such as, but not limited to embossments such as raised ribs or tabs, or even a rough or textured surface, each to present a frictional grip.

Figure 5:
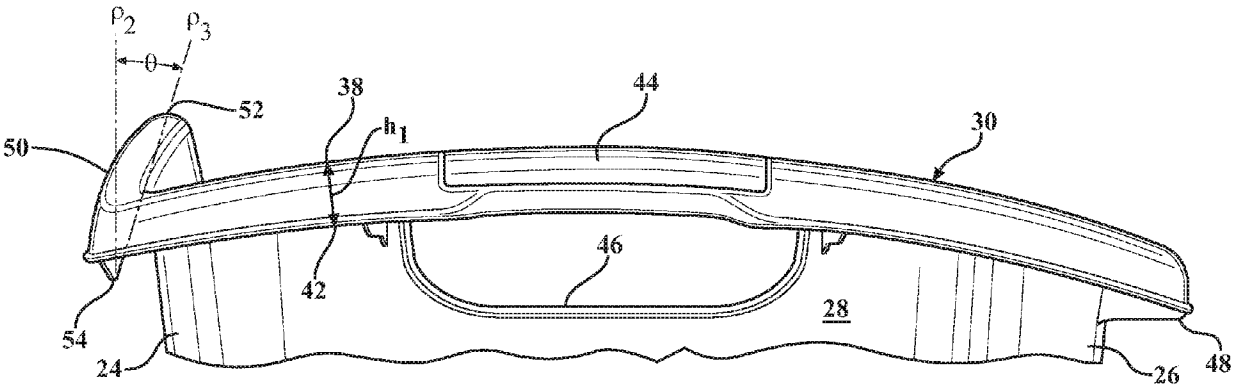
FIG. 5 is an enlarged side view taken within the circle labeled 5 of FIG. 3.

As best shown in FIG. 5, the top 38 of the engaging area 50 of the rim 30 defines an apex 52 along the rim 30 which is equidistant from each of the side walls 28. The edge 42 the engaging area 50 of the rim 30 defines a midpoint 54 along the rim 30 which is equidistant from each of the side walls 28 and is spaced a second distance $d_2$ from the lower plane $\rho_1$. A vertical plane $\rho_2$ extends through the midpoint 54 of the engaging area 50 of the rim 30 and is perpendicular to the lower plane $\rho_1$. The engaging area 50 of the rim 30 defines a support plane $\rho_3$ which extends through the midpoint 54 of the engaging area 50 of the rim 30 and through the apex 52 of the engaging area 50 of the rim 30. As best shown in FIG. 3, the second distance $d_2$ of the midpoint 54 of the engaging area 50 extends along the concave wall 24 a greater distance from the lower plane $\rho_1$ than the first distance $d_1$ of the reference point 48 of the edge 42 of the rim 30 extends along the convex wall 26 from the lower plane $\rho_1$.

Figure 4:
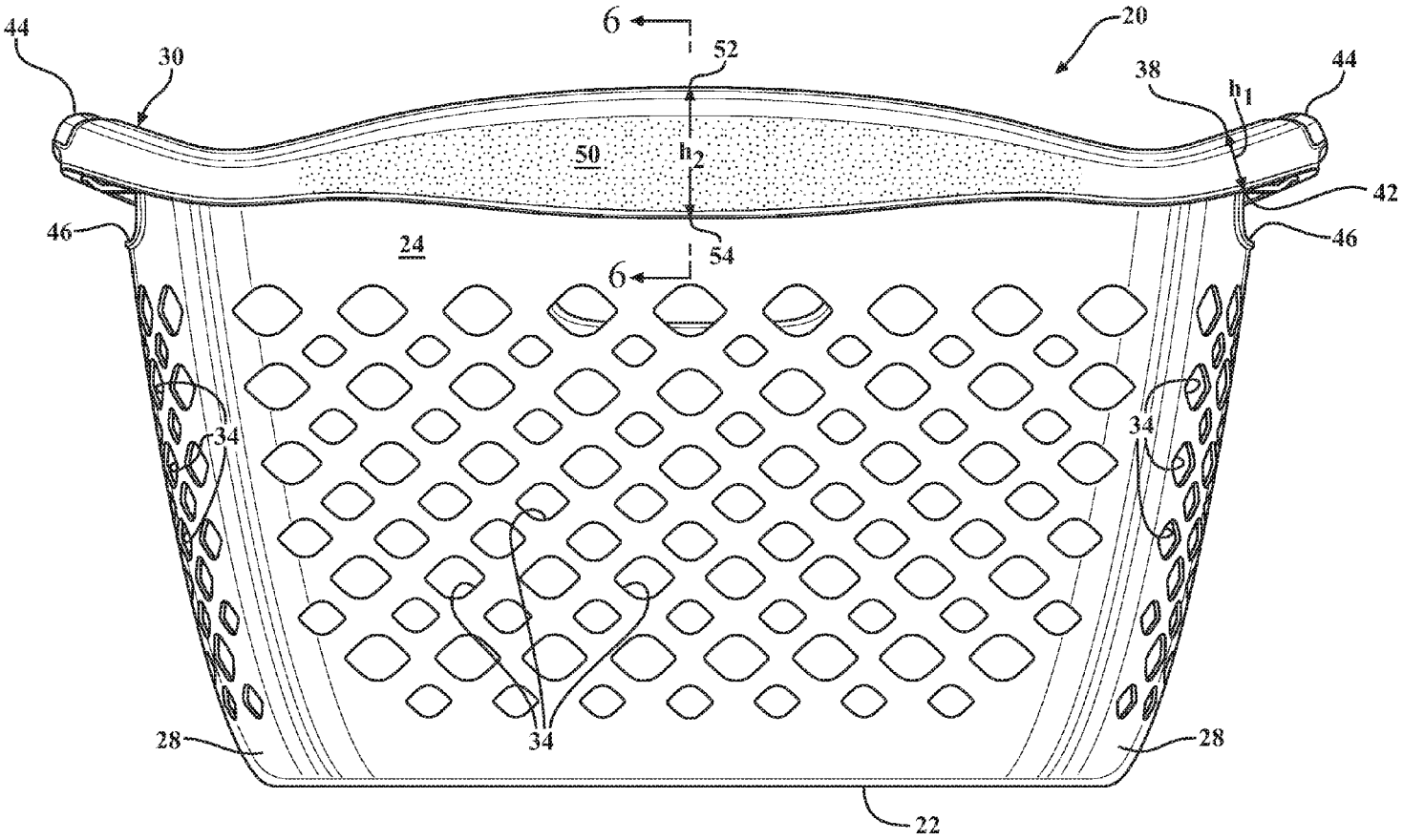
FIG. 4 is a side view of the concave wall along the line 4-4 of FIG. 2.

As best shown in FIG. 4, the container 20 as described herein is characterized by the apex 52 of the engaging area 50 being disposed a greater distance from the base 22 than the distance of the top 38 of the rim 30 from the base 22 along the side walls 28 and the convex wall 26, whereby the engaging area 50 presents a concave surface area for supporting the container 20 on the hip of a human body. In other words, the engaging area 50 extends higher than the rest of the container 20. As best shown in FIG. 5, the container 20 is further characterized by the second dimension $h_2$ of the engaging area 50 decreasing in height along the rim 30 from the apex 52 of the engaging area 50 and the midpoint 54 of the engaging area 50 toward each of the side walls 28. In addition, the support plane $\rho_3$ of the engaging area 50 of the rim 30 slants relative to the vertical plane $\rho_2$ at an acute angle $\theta$ which allows the engaging area 50 to rest comfortably on the human body.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. In addition, the reference numerals in the claims are merely for convenience and are not to be read in any way as limiting.

What is claimed is:

1. A container (20) having a concave side for engaging the hip of a human body while being grasped on an opposite convex side by an arm extending from that human body, said container (20) comprising;

a base (22) and a concave wall (24) and a convex wall (26) and a pair of side walls (28) with said concave wall (24) and said convex wall (26) and said side walls (28) extending upwardly from said base (22) to a rim (30) surrounding a chamber (32) therein to define a cross section with said convex wall (26) bowed out of said chamber (32) and said concave wall (24) bowed into said chamber (32), said rim (30) extending about said concave wall (24) and said convex wall (26) and said side walls (28) and defined by an inner leg (36) extending from said concave wall (24) and said convex wall (26) and said side walls (28) to an arcuate top (38) having an arcuate shaped cross section and further extending from said arcuate top (38) in an outer leg (40) to present an edge (42) extending about and spaced outwardly from said concave wall (24) and said convex wall (26) and said side walls (28), said rim (30) presenting an engaging area (50) extending along said concave wall (24) and presenting a concave surface area for supporting the container (20) on the hip of a human body, said arcuate top (38) of said rim (30) along said concave wall (24) being disposed a greater distance from said base (22) than said arcuate top (38) is disposed from said base (22) along said side walls (28) and said convex wall (26), said arcuate top (38) of said rim (30) along said side walls (28) being disposed a greater distance from said base (22) than said arcuate top (38) of said rim (30) is disposed from said base (22) along said convex wall (26), said outer leg (40) of said rim (30) extending a first dimension ($h_1$) between said arcuate top (38) of said rim (30) and said edge (42) of said rim (30) along said side walls (28) and along said convex wall (26), said outer leg (40) of said rim (30) further extending a second dimension ($h_2$) between said arcuate top (38) of said rim (30) and said edge (42) of said rim (30) along said concave wall (24) to present said engaging area (50) in said rim (30), said arcuate top (38) of said engaging area (50) of said rim (30) defining an apex (52) along said rim (30) equidistant from each of said side walls (28), said edge (42) of said engaging area (50) of said rim (30) defining a midpoint (54) along said rim (30) equidistant from each of said side walls (28), said apex (52) of said engaging area (50) being disposed a greater distance from said base (22) than said arcuate top (38) of said rim (30) along said convex wall (26) and along said side walls (28) to further define said engaging area (50), said second dimension ($h_2$) of said engaging area (50) between said arcuate top (38) and said edge (42) of said rim (30) decreasing in height along said rim (30) from said apex (52) and said midpoint (54) of said engaging area (50) toward each of said side walls (28), said arcuate top (38) of said engaging area (50) of said rim (30) continuously decreasing in height relative to said base (22) from said apex (52) of said engaging area (50) toward each of said side walls (28), said edge (42) of said engaging area (50) of said rim (30) continuously increasing in height relative to said base (22) from said midpoint (54) of said engaging area (50) toward each of said side walls (28).

2. The container (20) as set forth in claim 1 wherein said base (22) defines a lower plane ($\rho_1$) wherefrom said concave wall (24) and said convex wall (26) and said side walls (28) diverge upwardly to said inner leg (36) of said rim (30), a vertical plane ($\rho_2$) extending through said midpoint (54) of said engaging area (50) of said rim (30) and being perpendicular to said lower plane ($\rho_1$), said engaging area (50) of said rim (30) defining a support plane ($\rho_3$) extending through said midpoint (54) of said engaging area (50) and through said apex (52) of said engaging area (50), said support plane ($\rho_3$) of said engaging area (50) of said rim (30) slanting relative to said vertical plane ($\rho_2$) at an acute angle ($\theta$) to allow said engaging area (50) to rest comfortably on the human body.

3. The container (20) as set forth in claim 1 wherein said convex wall (26) defines a reference point (48) along said edge (42) of said rim (30) equidistant from each of said side walls (28) and being spaced a first distance ($d_1$) from said lower plane ($\rho_1$), said midpoint (54) of said engaging area (50) of said rim (30) being spaced a second distance ($d_2$) from said lower plane ($\rho_1$), said second distance ($d_2$) of said midpoint (54) of said engaging area (50) extending along said concave wall (24) a greater distance from said lower plane ($\rho_1$) than said first distance ($d_1$) of said reference point (48) of said edge (42) of said rim (30) extends along said convex wall (26) from said lower plane ($\rho_1$).

4. The container (20) as set forth in claim 1 wherein said second dimension ($h_2$) of said engaging area (50) extending along said concave wall (24) is greater than said first dimension ($h_1$) of said rim (30) along said convex wall (26) and along said side walls (28) to present said engaging area (50) in said rim (30) as being larger along said concave wall (24) than presented by the remainder of said rim (30) along said convex wall (26) and along said side walls (28).

5. The container (20) as set forth in claim 1 wherein said engaging area (50) of said rim (30) defines an elongated oval shape being flexible inwardly toward said inner leg (36) of said rim (30) and toward said concave wall (24) while being held against the human body.

6. The container (20) as set forth in claim 1 wherein said walls (24, 26, 28) presenting an array of holes (34) disposed in a plurality of rows with each row extending transversely to and between said rim (30) and said base (22) with said rows being equally spaced apart along said concave wall (24) and said convex wall (26) and said side walls (28).

7. The container (20) as set forth in claim 1 wherein said arcuate top (38) of said rim (30) includes a plurality of handles (44) attached flush with said arcuate top (38) of said rim (30) along said convex wall (26) and each of said side walls (28) for decorative purposes.

8. The container (20) as set forth in claim 7 wherein said convex wall (26) and said side walls (28) each define a grip opening (46) with each grip opening (46) disposed adjacent said rim (30) and extending toward said base (22) to allow grasping of said rim (30) at each of said handles (44) for carrying said container (20).

9. The container (20) as set forth in claim 1 wherein said engaging area (50) of said rim (30) includes a gripping texture disposed on said engaging area (50) to inhibit slippage of said engaging area (50) while being held against the human body.

10. A container (20) having a concave side for engaging the hip of a human body while being grasped on an opposite convex side by an arm extending from that human body, said container (20) comprising;

a base (22) and a concave wall (24) and a convex wall (26) and a pair of side walls (28) with said concave wall (24) and said convex wall (26) and said side walls (28) extending upwardly from said base (22) to a rim (30) surrounding a chamber (32) therein, said concave wall (24) being arcuate between said side walls (28) and bowed into said chamber (32) toward said convex wall (26), said convex wall (26) being arcuate between said side walls (28) and bowed out of said chamber (32) away from and generally parallel to said concave wall (24), said concave wall (24) and said convex wall (26) and said side walls (28) presenting an array of holes (34) disposed in a plurality of rows with each row extending transversely to and between said rim (30) and said base (22) with said rows being equally spaced apart along said concave wall (24) and said convex wall (26) and said side walls (28), said rim (30) extending about said concave wall (24) and said convex wall (26) and said side walls (28) and defined by an inner leg (36) extending from said concave wall (24) and said convex wall (26) and said side walls (28) to an arcuate top (38) having an arcuate shaped cross section and further extending from said arcuate top (38) in an outer leg (40) to present an edge (42) extending about and spaced outwardly from said concave wall (24) and said convex wall (26) and said side walls (28), said outer leg (40) of said rim (30) extending a first dimension ($h_1$) between said arcuate top (38) of said rim (30) and said edge (42) of said rim (30) along said side walls (28) and said convex wall (26), said arcuate top (38) of said rim (30) extending along said side walls (28) a greater distance from said base (22) than said arcuate top (38) of said rim (30) extends from said base (22) along said convex wall (26), said arcuate top (38) of said rim (30) including a plurality of handles (44) attached flush with said arcuate top (38) of said rim (30) along said convex wall (26) and each of said side walls (28) for decorative purposes, said convex wall (26) and said side walls (28) each defining a grip opening (46) with each grip opening (46) disposed adjacent said rim (30) and extending toward said base (22) to allow grasping of said rim (30) at each of said handles (44) for carrying said container (20), said base (22) defining a lower plane ($\rho_1$) wherefrom said concave wall (24) and said convex wall (26) and said side walls (28) diverge upwardly to said inner leg (36) of said rim (30), said convex wall (26) defining a reference point (48) along said edge (42) of said rim (30) equidistant from each of said side walls (28) and being spaced a first distance ($d_1$) from said lower plane ($\rho_1$), said outer leg (40) of said rim (30) further extending a second dimension ($h_2$) between said arcuate top (38) of said rim (30) and said edge (42) of said rim (30) along said concave wall (24) to present an engaging area (50) in said rim (30), said second dimension ($h_2$) of said engaging area (50) extending along said concave wall (24) being greater than said first dimension ($h_1$) of said rim (30) along said convex wall (26) and along said side walls (28) to present said engaging area (50) in said rim (30) as being larger along said concave wall (24) than presented by the remainder of said rim (30) along said convex wall (26) and along said side walls (28), said engaging area (50) of said rim (30) including a gripping texture disposed on said engaging area (50) to inhibit slippage of said engaging area (50) while being held against the human body, said arcuate top (38) of said engaging area (50) of said rim (30) defining an apex (52) along said rim (30) equidistant from each of said side walls (28), said edge (42) said engaging area (50) of said rim (30) defining a midpoint (54) along said rim (30) equidistant from each of said side walls (28) and being spaced a second distance ($d_2$) from said lower plane ($\rho_1$), a vertical plane ($\rho_2$) extending through said midpoint (54) of said engaging area (50) of said rim (30) and being perpendicular to said lower plane ($\rho_1$), said engaging area (50) of said rim (30) defining a support plane ($\rho_3$) extending through said midpoint (54) of said engaging area (50) of said rim (30) and through said apex (52) of said engaging area (50) of said rim (30), said engaging area (50) of said rim (30) having an elongated oval shape being flexible inwardly toward said inner leg (36) of said rim (30) and toward said concave wall (24) while being held against the human body, said second distance ($d_2$) of said midpoint (54) of said engaging area (50) extending along said concave wall (24) a greater distance from said lower plane ($\rho_1$) than said first distance ($d_1$) of said reference point (48) of said edge (42) of said rim (30) extends along said convex wall (26) from said lower plane ($\rho_1$), and characterized by, said engaging area (50) extending along said concave wall (24) and presenting a concave surface area for supporting the container (20) on the hip of a human body, said arcuate top (38) of said rim (30) along said concave wall (24) being disposed a greater distance from said base (22) than said arcuate top (38) is disposed from said base (22) along said side walls (28) and said convex wall (26), said second dimension ($h_2$) of said engaging area (50) between said arcuate top (38) and said edge (42) of said rim (30) decreasing in height along said rim (30) from said apex (52) and said midpoint (54) of said engaging area (50) toward each of said side walls (28), said arcuate top (38) of said engaging area (50) of said rim (30) continuously decreasing in height relative to said base (22) from said apex (52) of said engaging area (50) toward each of said side walls (28), said edge (42) of said engaging area (50) of said rim (30) continuously increasing in height relative to said base (22) from said midpoint (54) of said engaging area (50) toward each of said side walls (28), said support plane ($\rho_3$) of said engaging area (50) of said rim (30) slanting relative to said vertical plane ($\rho_2$) at an acute angle ($\theta$) allowing said engaging area (50) to rest comfortably on the human body.

* * * * *